US005963174A

United States Patent [19]

Larsson et al.

[11] Patent Number: 5,963,174

[45] Date of Patent: Oct. 5, 1999

[54] ANTENNA DEVICE IN CAR RADAR SYSTEM

[75] Inventors: Thomas Larsson, Kungsangen; Arne Silen; Thomas Andersson, both of Jarfalla, all of Sweden

[73] Assignee: Celsiustech Electronics AB, Jarfalla, Sweden

[21] Appl. No.: 08/945,829

[22] PCT Filed: Apr. 19, 1996

[86] PCT No.: PCT/SE96/00514

§ 371 Date: Mar. 5, 1998

§ 102(e) Date: Mar. 5, 1998

[87] PCT Pub. No.: WO96/36088

PCT Pub. Date: Nov. 14, 1996

[30] Foreign Application Priority Data

May 9, 1995 [SE] Sweden ..... 9501706

[51] Int. Cl.[6] ..... H01Q 3/00

[52] U.S. Cl. ..... 343/766; 343/761

[58] Field of Search ..... 343/758, 760, 343/761, 763, 766, 839, 840

[56] References Cited

U.S. PATENT DOCUMENTS

| | | | |
|---|---|---|---|
| 3,552,456 | 1/1971 | Johansson | 144/208 |
| 4,656,484 | 4/1987 | Brown et al. | 343/761 |
| 4,665,401 | 5/1987 | Garrard et al. | 342/75 |
| 4,991,211 | 2/1991 | Cap et al. | 360/84 |
| 5,012,170 | 4/1991 | Atlas | 343/766 |
| 5,351,060 | 9/1994 | Bayne | 343/766 |
| 5,619,215 | 4/1997 | Sydor | 343/766 |
| 5,633,647 | 5/1997 | Tines | 343/766 |

FOREIGN PATENT DOCUMENTS 0 631 367 A1 12/1994 European Pat. Off. .

*Primary Examiner*—Hoanganh Le
*Assistant Examiner*—Tan Ho
*Attorney, Agent, or Firm*—Pollock, Vande Sande & Amernick

[57] ABSTRACT

An antenna device used in a car radar system for emitting and/or receiving electromagnetic radiation, comprises a rotatable reflector; a feeder fixed relative to the antenna device and interacting with the reflector; a motor for driving the reflector; and a tachometer for monitoring the rotation of the reflector and for controlling the drive motor. The drive motor and the tachometer are constituted by flag motors, each having a rotor with flat coils and a stator including permanent magnets, the rotor being rotatable in a magnetic field created by permanent magnets and having the coil ends directed towards the permanent magnets, the rotors of the flag motors being rigidly, mechanically connected to each other.

11 Claims, 2 Drawing Sheets

ANTENNA DEVICE IN CAR RADAR SYSTEM

FIELD OF THE INVENTION

The present invention relates to an antenna device for emitting and/or receiving electromagnetic radiation, such as radar radiation in, for example, a car radar apparatus. The antenna device comprises a rotatable reflector, a feeder which is fixed relative to the antenna device and interacts with the reflector, a motor for driving the reflector and a tachometer for monitoring the rotation of the reflector and for controlling the drive motor.

BACKGROUND OF THE INVENTION

In certain applications, for example within the car radar field, there is a need for an antenna device having an antenna beam which can sweep a limited range of angle in the order of magnitude of some ten degrees, for example 20°, but which does not need to cope with large angle sectors or a complete revolution.

A conventional method for sweeping a region is to rotate both the feeder and the antenna reflector. In this way, both small and large ranges of angle can be swept. Known realizations of this method have proved however to be both costly and space-consuming and are not suitable for use in a car radar, for example, in which the space which might be available for use is very limited and the need for a low price is extremely important.

It is also known to realize the sweeping electronically using a fixed antenna. In order to realize a sweeping of the region according to the above, as is required in a car radar, the solutions remain complicated and expensive and limitation to a smaller sweeping range in which simpler solutions can be utilized has an adverse effect upon the functioning and reliability of the car radar.

In order to realize sweeping within a limited region, it has previously been proposed to utilize a rotatable reflector in combination with a fixed feeder. The reflector can in this case be driven, for example, by means of a stepping motor.

SUMMARY OF THE INVENTION

The object of the present invention is to provide an antenna device according to the principle of the preceding paragraph, having a fixed feeder and a rotatable reflector, which is simple, strong, compact and reliable, while at the same time demanding a low price. This is achieved by an antenna device having a drive motor for driving the reflector and a tachometer for monitoring the rotation of the reflector in the form of two interacting flag motors (voice coil motors). The antenna device is here characterized in that the drive motor and the tachometer are constituted by so-called flag motors, i.e. motors having flat coils fitted so as to move in a magnetic field created by permanent magnets and having the coil ends directed towards the permanent magnets, the rotors of the motors being mutually rigidly connected to each other mechanically.

It is worth pointing our that flag motors per se are known and are used, among other things, for positioning in hard disks and CD-players. In this case, no use is made of the interaction between two motors and the field of application in question is totally different, having different drive and control requirements.

According to an advantageous embodiment, the rotors of the flag motors are arranged so as to rotate about a common rotary axle, which common rotary axle is arranged to support the reflector of the antenna device. This embodiment has advantageous characteristics in terms of, among other things, compactness and motional stability. The rotors of the flag motors can herein advantageously be constituted by a common component which is designed in one piece. Furthermore, a bearing member supporting the reflector of an antenna device can be designed in one piece with the rotor of the drive motor and/or tachometer.

According to another advantageous embodiment, the drive motor is disposed behind and the tachometer in front of the common rotary axle which supports the reflector of the antenna device. This positioning of the drive motor and tachometer enables effective use of the space available in the antenna device. In order to make even more effective use of the space, according to yet another advantageous embodiment the rotor of the drive motor and the rotor of the tachometer can be fitted each in its own non-coincident, parallel plane. The drive motor is normally dimensioned to be substantially more powerful than the tachometer and therefore requires more space. The placement of the more space-consuming drive motor behind the rotary axle which supports the reflector of the antenna device, in combination with a more compact tachometer in front of the rotary axle, enables the best possible use of the space in the antenna device, without the sweep of the antenna being thereby disturbed.

In order to limit the rotary motions of the rotors, according to a further embodiment the drive motor and/or the tachometer can further be provided with stop members which limit the rotary motions of the rotors in question. Preferably, the stop members contain motion-damping material, such as rubber, for example.

BRIEF DESCRIPTION OF THE DRAWINGS

The invention is to be described in greater detail below with reference to appended drawings, in which.

DETAILED DESCRIPTION OF THE PREFERRED EMBODIMENT(S)

Figure 1:
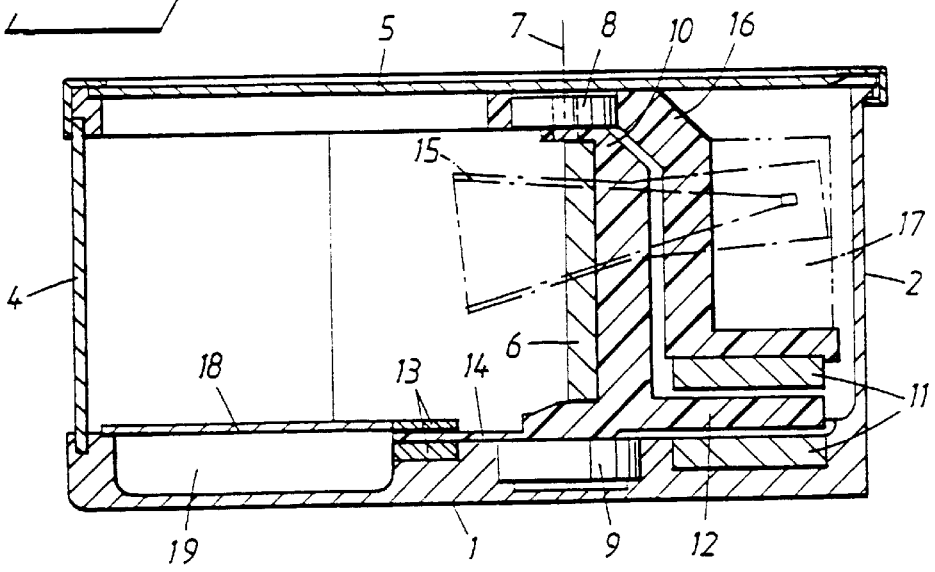
FIG. 1 shows diagrammatically, in cut side view, an example of an antenna device according to the invention.
Figure 2:
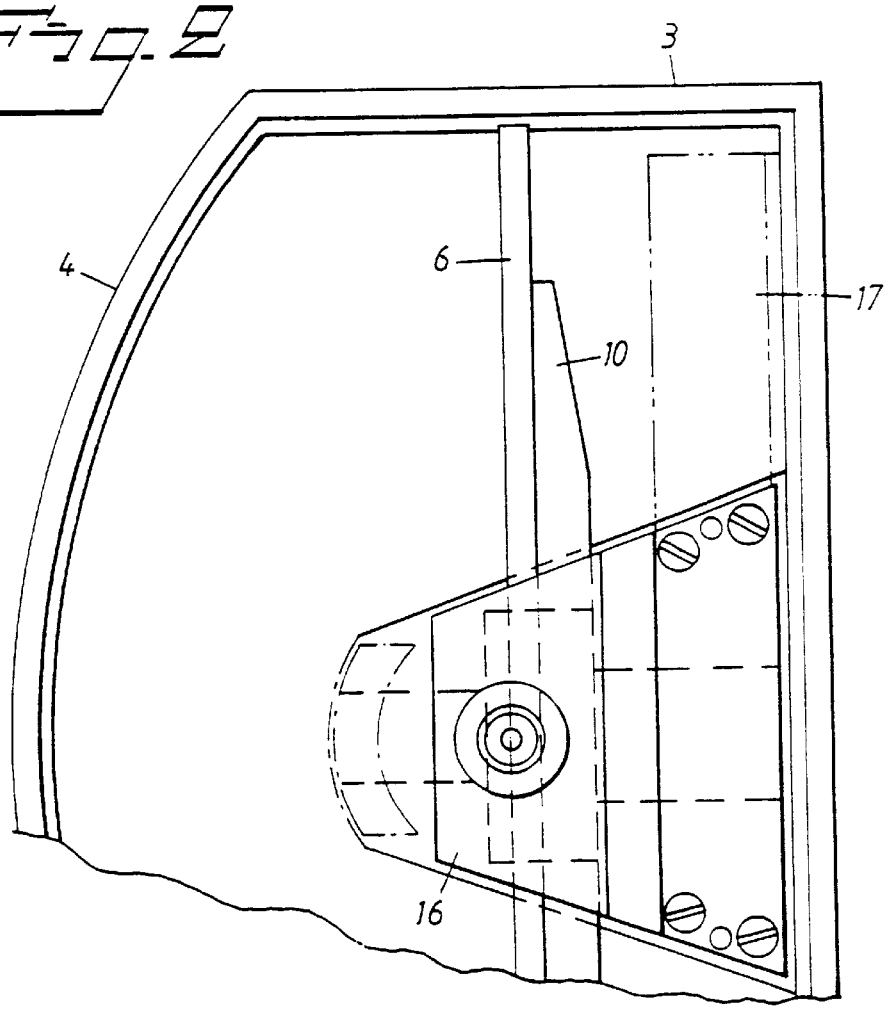
FIG. 2 shows diagrammatically, in top view, the antenna device according to FIG. 1.

The antenna device is described below with reference to FIGS. 1 and 2. The antenna device is limited by a casing comprising a bottom part 1 having side walls 2, 3, an arched front part 4 constituting the radome and sub-reflector, and a cover 5. A reflector 6 is rotatably fitted around an axle 7 by a bearing member 10 mounted on each side of the reflector in bearings 8, 9 of, for example, the ball-bearing type or some other suitable form of bearing. The reflector 6 is rotated about the axle 7 by means of a drive motor comprising a fixed motor part 11 and a movable motor part or rotor 12. The rotary motion is detected by a tachometer having a fixed part 13 and a movable part or rotor 14. A fixed feeder 15 in the form of a horn is supported by a supporting element 16 fitted between the drive motor and the bearing 8. Adjoining the supporting element, accommodation is also provided for the microwave unit 17 of the antenna device. In the bottom part of the casing 1 there is additionally space for the electronics 18 and for cooling fins 19. The electronics can be mounted on a printed circuit board.

During operation, a radar signal in the microwave range is emitted by the feeder 15. The signal is reflected from the sub-reflector 4 back towards the reflector 6. The reflector 6 reflects the signal towards the sub-reflector 4, which this time transmits the signal due to the fact that the polarization of the signal has changed during the course of reflection as a result of the signal having been reflected from the sub-reflector. An incoming signal to the radar device follows the same course as the emitted signal, but in the reverse order. By rotating the reflector 6 to and from about the rotary axle 7 using a drive motor 11, 12, the radar beam is made to sweep within a range of angle which is determined by the rotary motion of the reflector in interaction with the sub-reflector 4. The tachometer 13, 14 monitors the rotary motions of the reflector and, via a servo (not shown), commands the drive motor 11, 12 to work within the established sweep frequency.

Figure 3:
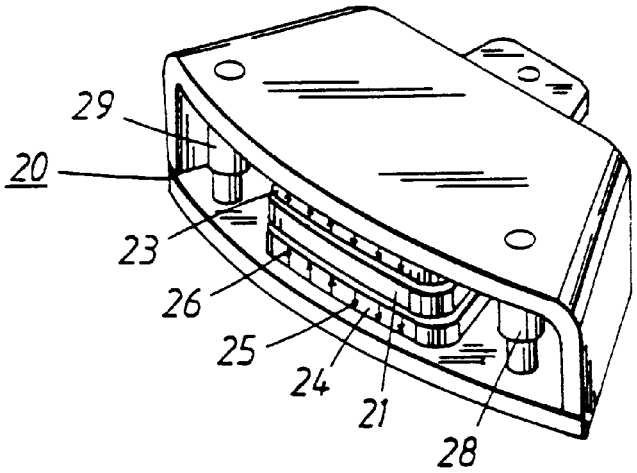
FIG. 3 shows diagrammatically, in perspective view, an example of a flag motor.
Figure 4:
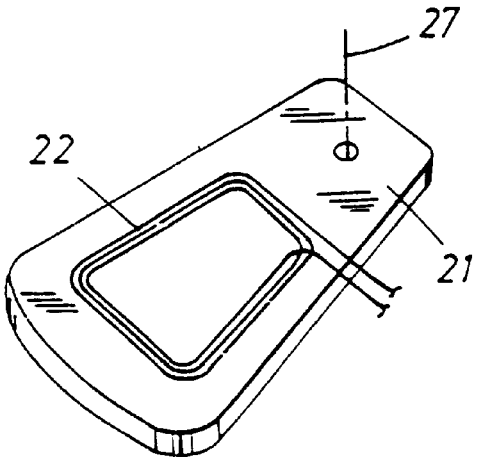
FIG. 4 shows, in perspective view, an example of the shape of the rotor of a flag motor and its rotor winding.

The drive motor and the tachometer are designed according to the principle for flag motors. FIGS. 3 and 4 show the diagrammatic structure of a flag motor. The flag motor 20 contains a plane rotor 21 provided with a coil 22 on each side, preferably glued or fixed-cast in the rotor. The rotor 21 is rotatable about an axle 27. On each side of the rotor 21 there are permanent magnets 23 and 24 respectively, which yield a constant field. Arrows 25 and 26 indicate the direction of the magnetic field in different parts of the permanent magnets. Each permanent magnet may possibly be replaced by two separate magnets of opposing magnetizations. When used as a drive motor, the coil of the rotor is fed with drive voltage. By measuring the voltage across the coil of the rotor, which is a function of its speed, the flag motor can be used as a tachometer. When used as a tachometer, there is no need for magnets being as strong as when used as a drive motor and the flag motor can then be made considerably smaller.

According to the embodiment described with reference to FIGS. 1 and 2, the rotors 12, 14 of the tachometer and drive motor are fixedly connected and constructed as a common piece together with the supporting member 10. The rotors can also, of course, be constituted by separated components which are suitably coupled together. The rotors 12, 14 and the supporting member 20 can be constructed in reinforced plastic, for example polyamide plastic with glass-fiber reinforcement. Good stability and adequate dimensional tolerances are obtained. It is also possible to use die-cast metal, but then account would have to be taken of induction currents in the metal. The tachometer 13, 14 is accommodated on the front side of the reflector 6, but, because of its small bulk, does not encroach upon the region within which the radar signal is transmitted. The drive motor 11, 12, which has a greater bulk, is accommodated on the rear side of the reflector. To ensure that the tachometer encroaches as little as possible upon the space in front of the reflector 6, the rotor 14 of the tachometer is connected to the rotor 12 of the drive motor so that the rotor 14 of the tachometer rotates in a plane closer to the bottom part 1 of the antenna device than to the rotor 12 of the drive motor.

In the known flag motor shown in FIG. 3, stop members 28, 29 have been inserted in order to limit the motion of the rotor. The stop members are clad with rubber or some other suitable damping material. The primary task of the stop members is to protect the flag motors from damage in the switched-off state. During operation, the rotors of the flag motors reverse before they reach the stop members.

We claim:

1. An antenna device used in a car radar system for emitting and/or receiving electromagnetic radiation, comprising:

a rotatable reflector;

a feeder fixed relative to the antenna device and interacting with the reflector;

a motor for driving the reflector; and a tachometer for monitoring the rotation of the reflector and for controlling the drive motor, the drive motor and the tachometer being constituted by flag motors, each having a rotor with flat coils and a stator including permanent magnets, said rotor being rotatable in a magnetic field created by permanent magnets and having the coil ends directed towards the permanent magnets, the rotors of the flag motors being rigidly, mechanically connected to each other.

2. An antenna device according to claim 1, wherein the rotors of the flag motors rotate about a common rotary axle which supports the reflector of the antenna device.

3. An antenna device according to claim 2, wherein the rotors of the flag motors are constituted by a common component designed in one piece.

4. An antenna device according to claim 2, wherein the drive motor is disposed behind and the tachometer in front of the common rotary axle which supports the reflector of the antenna device.

5. An antenna device according to claim 2, further comprising a bearing member for supporting the reflector of an antenna device, and designed in one piece with at least one of the rotor of the drive motor and the tachometer.

6. An antenna device according to claim 2, wherein the common rotary axle is mounted at both ends by means of ball bearings.

7. An antenna device according to claim 2, wherein the rotor of the drive motor and the rotor of the tachometer are each fitted in its own non-coincident, parallel plane.

8. An antenna device according to claim 1, wherein the drive motor is dimensioned to be substantially more powerful than the tachometer.

9. An antenna device according to claim 1, wherein at least one of the drive motor and the tachometer is provided with stop members for limiting the rotary motions of the rotors.

10. An antenna device according to claim 9, wherein the stop members contain motion-dumping material.

11. An antenna device according to claim 10 wherein said motion-dumping material is rubber.

* * * * *